US007071837B2

(12) United States Patent
Hudson et al.

(10) Patent No.: US 7,071,837 B2
(45) Date of Patent: Jul. 4, 2006

(54) DATA TRANSMISSION IN PIPELINE SYSTEMS

(75) Inventors: Steven Martin Hudson, Sturminster Newton (GB); Daniel Joinson, Carterton (GB)

(73) Assignee: Expro North Sea Limited, Reading (GB)

( * ) Notice: Subject to any disclaimer, the term of this patent is extended or adjusted under 35 U.S.C. 154(b) by 888 days.

(21) Appl. No.: 10/032,468

(22) Filed: Jan. 2, 2002

(65) Prior Publication Data

US 2002/0084913 A1 Jul. 4, 2002

Related U.S. Application Data

(63) Continuation-in-part of application No. PCT/GB00/02538, filed on Jun. 30, 2000.

(30) Foreign Application Priority Data

| | | |
|---|---|---|
| Jul. 7, 1999 | (GB) | 9915968 |
| Oct. 11, 1999 | (GB) | 9924027 |
| Jan. 3, 2001 | (GB) | 0100107 |

(51) Int. Cl.
*G01V 3/00* (2006.01)

(52) U.S. Cl. ..... 340/854.3; 340/854.4; 340/854.5; 175/40

(58) Field of Classification Search ..... 340/854.3, 340/854.4, 854.5, 854.6; 367/82; 166/73; 175/40

See application file for complete search history.

(56) References Cited

U.S. PATENT DOCUMENTS

| | | | |
|---|---|---|---|
| 2,364,957 A | 12/1944 | Douglas | |
| 3,129,394 A | 4/1964 | Long | |
| 3,150,321 A | 9/1964 | Summers | 325/28 |

(Continued)

FOREIGN PATENT DOCUMENTS

| | | |
|---|---|---|
| EP | 0 295 712 A2 | 12/1988 |
| EP | 0 646.304 | 4/1995 |
| EP | 0 816 632 A1 | 1/1998 |

(Continued)

OTHER PUBLICATIONS

R. Magliona et al., "Electromagnetic Transmission Improvements Applied to On/offshore Drilling in the Mediterran an Area," Feb. 1194.

(Continued)

*Primary Examiner*—Timothy Edwards, Jr.
(74) *Attorney, Agent, or Firm*—Finnegan, Henderson, Farabow, Garrett, Dunner, L.L.P.

(57) ABSTRACT

Data transmission in pipeline systems A first set of apparatus is arranged for transmitting data from a point in a cased section of a well 1, 3 to a remote location. The apparatus may be used as a relay station 6 to increase operational depth. Signals are applied to and received from the string 1 at the relay station 6 and a selected length of the string 1 is provided with insulating spacer means 9 on either side of the relay station to ensure that the string 1 and casing 3 are effectively isolated for a selected minimum distance. This enables potential differences to be both applied to and detected from the string 1, thus allowing data transmission and reception. A second set of apparatus is arranged for transmitting from an internal unit 408 inside a cased section of the well 401, 403 to the immediate surrounding area outside the casing 403. The internal unit 408 injects current into the string 401. A toroid 415 which surrounds the casing 403 is provided to pick up signals. Spaced connections between the string 401 and casing 403 are provided by conductive packers 411. A mismatch in the current flowing in the string 401 and casing 403 is generated so that a non-zero flux is seen by the toroid and hence a signal can be received.

31 Claims, 6 Drawing Sheets

U.S. PATENT DOCUMENTS

| | | | | | |
|---|---|---|---|---|---|
| 3,333,239 | A | | 7/1967 | Silverman | 340/18 |
| 3,697,940 | A | * | 10/1972 | Berka | 367/82 |
| 3,831,138 | A | | 8/1974 | Rammner | 340/18 LD |
| 4,525,715 | A | | 6/1985 | Smith | 340/854 |
| 4,684,946 | A | | 8/1987 | Issenmann | 340/855 |
| 4,785,247 | A | | 11/1988 | Meador et al. | 324/338 |
| 4,845,494 | A | * | 7/1989 | Hanson et al. | 340/854.5 |
| 5,130,706 | A | | 7/1992 | Van Steenwyk | 340/854.6 |
| 5,189,415 | A | | 2/1993 | Shimada et al. | 340/854.6 |
| 5,394,141 | A | | 2/1995 | Soulier | 340/854.4 |
| 5,396,232 | A | | 3/1995 | Mathieu et al. | 340/854.5 |
| 5,512,889 | A | | 4/1996 | Fletcher | 340/854.6 |
| 5,576,703 | A | | 11/1996 | MacLeod et al. | 340/854.4 |
| 5,883,516 | A | * | 3/1999 | Van Steenwyk et al. | 324/366 |
| 5,945,923 | A | | 8/1999 | Soulier | 340/854.6 |
| 6,515,592 | B1 | * | 2/2003 | Babour et al. | 340/854.4 |

FOREIGN PATENT DOCUMENTS

| | | |
|---|---|---|
| EP | 0 995 877 A1 | 4/2000 |
| EP | 1 130 418 A1 | 9/2001 |
| FR | 2.205.996 | 5/1974 |
| WO | WO93/26115 | 12/1993 |
| WO | WO 98/06924 | 2/1998 |
| WO | WO 99/08035 | 2/1999 |
| WO | WO99/37044 | 7/1999 |

OTHER PUBLICATIONS

L. Soulier et al., "E.M. MWD Data Transmission Status and Perspectiv s," paper prepared for pres ntation at 1993 SPE/IADC Drilling conference held in Amsterdam Feb. 23–25, 1993.

Second–generation MWD tool'< Oil and Gas Journal, Feb. 1983.

H. Yasuharu, "Data Transmission System," Patent Abstracts of Japan of JP Pub No. 57026942 (Feb. 13, 1982).

I. Takashi, "Method and Device for Underwater Signal Transmission", Patent Abstracts of Japan of JP 56078240, filed Jun. 27, 1981.

* cited by examiner

DATA TRANSMISSION IN PIPELINE SYSTEMS

CROSS REFERENCE TO RELATED APPLICATIONS

This is a Continuation-In-Part of International Patent Application No. PCT/GB00/02538, filed Jun. 30, 2000, which claims priority to Great Britain Patent Application No. 9915968.3, filed Jul. 7, 1999, Great Britain Patent Application No. 9924027.7, filed Oct. 11, 1999, and Great Britain Patent Application No. 0100107.2, filed Jan. 3, 2001.

This invention relates to data transmission systems, methods of data transmission, signal receiving apparatus and methods of receiving signals all for use in pipeline systems, in particular wells.

It is useful to be able to take measurements when drilling for oil and gas and during the operation of producing wells. However, it is difficult to transmit data from downhole locations to the surface and the difficulty increases with depth. At present there is a requirement for data transmission from 3000 meters or more below the surface.

Of the signalling techniques currently available those which make use of the metallic structure of the well itself are particularly preferred as they remove the need to install separate wirelines. Most non-wireline systems make use of the production string and casing as a single conducting channel and use earth as the return path. Some attempts have been made to use the casing and string as separate conduction paths but this is fraught with problems because of the difficulties in isolating the string from the casing throughout its length and in particular at the wellhead because of the loads involved. Other methods include "mud-pulsing" which is not only difficult to implement and expensive but also gives a poor data rate.

Whichever system is used, the range is limited because of the inherent losses involved and the need to keep currents at reasonable levels. Further, to the applicant's knowledge no practical non-wireline systems are currently available for signalling from locations on the string within the casing. The communication system described in the applicant's earlier application EP-A-0,646,304, for example, works in open hole conditions and can transmit a signal along a cased section. However it is generally accepted that such a system cannot be used in practice to transmit from a position within a cased section.

In pipeline systems it is also desirable to be able to transmit signals from an apparatus within a flowline and/or the associated casing to an apparatus in the same region of the system but outside the flowline and/or casing. However, it is generally accepted that this is difficult to achieve.

It is an object of the present invention to provide communications systems which alleviate at least some of the problems associated with the prior art.

According to a first aspect of the present invention there is provided a data transmission system in which metallic structure of a pipeline system is used as a signal channel and earth is used as return comprising means for forming a current loop path having first and second conducting portions electrically connected to one another at spaced locations, the metallic structure comprising at least one of the conducting portions, and a local unit having transmitting means for applying a signal to one of the conducting portions whereby in use current flows around said loop generating a potential difference between earth and the metallic structure in the region of the loop and causing a signal to be propagated along the metallic structure away from the loop, wherein the means for forming the current loop path is arranged to ensure that the spaced locations are separated by at least a minimum distance selected to give desired transmission characteristics.

According to a second aspect of the present invention there is provided a method of data transmission in which metallic structure of a pipeline system is used as a signal channel and earth is used as return comprising the steps of:

forming a current loop path having first and second conducting portions electrically connected to one another at spaced locations, the metallic structure comprising at least one of the conducting portions;

applying a signal to one of the conducting portions to cause a current to flow around said loop to generate a potential difference between earth and the metallic structure in the region of the loop and cause a signal to be propagated along the metallic structure away from the loop; and ensuring that the spaced locations are separated by at least a minimum distance selected to give desired transmission characteristics.

The pipeline system may comprise an inner flow line and a surrounding casing. Typically the pipeline system comprises a well having a production string and surrounding casing.

The current flowing around the loop path in operation can be considered to make the system act as a dipole transmitter.

Receiving means may be provided at a location remote from said current loop path for receiving the signals propagated along the metallic structure.

The above arrangement has the advantages that wirelines can be avoided and a signal which will be detectable can be injected onto the metallic structure in practical situations using realistic current levels even when signalling along a production string from a position in which the string is located within a casing. Away from the region of the current loop path, the metallic structure as whole may be treated as a single conduction channel.

The minimum distance can be chosen to suit the circumstances such that an acceptable level of signal is detectable at the desired location remote from the local unit, for example at the well head. A typical selected minimum distance may be 100 meters. It is preferred that the selected minimum distance is small relative to the overall length of the structure/well.

Preferably one of the conducting portions comprises a portion of a production string. The transmitting means may be arranged to apply signals to the production string.

In some embodiments one conducting portion comprises a portion of a flow line, for example a production string and the other conducting portion comprises a surrounding portion of casing. In such embodiments the means for forming a current loop path may comprise insulating spacer means for keeping the flow line spaced from the surrounding casing for the selected minimum distance. An insulating coating may be provided on the flow line and/or casing over the portion corresponding to the selected minimum distance. The spaced connections between the first and second conducting portions to complete the current loop path may comprise glancing contacts between the flow line and casing beyond the selected region. It will be appreciated that the costs involved in improving isolation between the flow line and casing over the selected minimum distance will be significantly lower than those involved in trying to isolate the string and casing along their whole length.

In other embodiments one conducting portion comprises a portion of a pipeline or flowline and the other conducting portion comprises at least one electrically conductive elongate member connecting at least two pigs disposed within the pipeline or flowline. In such embodiments the spaced connections to complete the current loop path may be provided at the pigs. The local unit may be provided at one of the pigs. Preferably the transmitting means is arranged to apply signals to the elongate member.

The local unit may comprise sensor means for measuring conditions in the region of the unit. The local unit may comprise receiving means for receiving incoming signals transmitted along the metallic structure or otherwise. The local unit may be arranged to act as a relay station. It will be appreciated that the relay station may be disposed on a cased section of production string and thus be used to improve the range of the data transmission system.

Preferably the transmitting means applies signals substantially at the midpoint of the respective conducting portion. This tends to equalise the signal propagation characteristics away from the local unit in both directions along the metallic structure and is particularly suitable if the local unit is to function as a bi-directional relay station.

On the other hand, if it is desired to increase the signal transmission in one direction, the transmitting means may be arranged to apply signals at a point towards one end, preferably the opposite end, of the respective conducting portion.

The transmitting means and/or the receiving means may comprise an isolation member disposed in series with the respective conducting portion. The transmitting means may comprise a signal generating means connected across the isolation member. The receiving means may comprise a signal measuring means, for example voltage measuring means, connected across the isolation member. Where the respective conducting portion comprises the production string the isolation member may be an isolation joint disposed in the string.

The transmitting means and/or the receiving means may comprise inductive coupling means disposed around the respective conducting portion. The current loop path may act as a single turn winding of a transformer. The inductive coupling means may comprise a coil wound on a generally toroidal core which encircles the respective conducting portion.

According to a third aspect of the present invention there is provided signal receiving apparatus for use with a data transmission system in which metallic structure of a pipeline system is used as a signal channel and earth is used as return, comprising a local unit having receiving means, means for providing electrical contact between the local unit and at least two spaced locations on a portion of the metallic structure and means for ensuring that the two spaced locations are separated by at least a minimum distance selected to give desired reception characteristics.

According to a fourth aspect of the present invention there is provided a method for receiving a signal from the metallic structure of a pipeline system which is used as a signal channel in a data transmission system with earth as return, comprising the steps of providing a local unit having receiving means; providing electrical contact between the local unit and at least two spaced locations on a portion of the metallic structure; and ensuring that the spaced locations are separated by at least a minimum distance selected such to give desired reception characteristics.

When a signal is transmitted along the metallic structure of a pipeline system the magnitude of the signal generally decreases as distance from the signal source is increased. This is mainly due to the gradual leakage to earth of the signal. Thus when a signal is travelling along the metallic structure there is a potential difference between any two longitudinally spaced points and it has been appreciated that providing a connection to two such points enables a signal to be extracted from the metallic structure. The minimum distance required depends on the signal level with respect to earth at the locations concerned and the sensitivity/noise performance of the receiving means.

The means for providing electrical contact at spaced locations may comprise a portion of the production string and insulating spacer means provided to keep said string portion spaced from the corresponding portion of surrounding casing. An isolation joint may be provided in the string in the region of the local unit and a signal measuring means connected across it. In this case, because the string is effectively isolated from the casing, all of the signal losses for that section of the metallic structure will be from the casing and there will be little potential drop along that portion of the string so that the potential difference between the spaced locations can be detected.

The means for providing electrical contact at spaced locations may comprise at least one electrically conductive elongate member connecting at least two pigs disposed within the production string.

According to a fifth aspect of the present invention there is provided signal receiving apparatus for use with a data transmission system in which metallic structure of a pipeline system is used as a signal channel, comprising a local unit having receiving means which comprises an inductive coupling.

The signal channel may be split into two or more branches in the region of the local unit and the inductive coupling disposed around one of said branches.

Preferably the inductive coupling is disposed around a production string disposed within a casing. One branch may comprise the production string and another branch may comprise the casing.

The inductive coupling may comprise a toroid disposed around said one of the channels and/or a production string.

According to a further aspect of the present invention there is provided a data transmission system in which metallic structure of a well including a production string and casing is used as a signal channel and earth is used as return comprising a local unit having receiving and/or transmitting means coupled to the string for receiving signals from and/or transmitting signals along the signal channel and insulating spacer means arranged to ensure that the production string and casing are spaced from one another for at least a selected minimum distance in the region of the local unit, said minimum distance being selected to give desired reception and/or transmission characteristics.

The casing may comprise a plurality of separate sections, which may be screwed together. Mating surfaces at one or more joint between adjacent sections may be coated with an isolating medium. This can change the electrical characteristics of the metal structure and enhance performance.

Many of the additional features described following the earlier aspects of the invention are equally appropriate for use in conjunction with said further aspect of the invention.

According to another aspect of the invention there is provided a data transmission system for use in pipeline systems which comprises, means for forming a current loop path comprising a portion of an inner conductive member and a corresponding portion of an outer conductive member electrically connected to one another at two spaced locations, the outer conducting member surrounding the inner conductive member and being part of the metallic structure of a pipeline system;

an internal unit disposed within the outer member and having transmission means for injecting a signal into the current loop path; and an external unit disposed outside the outer member comprising inductive coupling means arranged to be linked by flux generated by current flowing around the loop path, the arrangement being such that in use the current flowing in said portion of the inner member does not match the current flowing in the corresponding portion of the outer member whereby signals are generated in the inductive coupling means so allowing communication from the internal unit to the external unit.

According to yet another aspect of the present invention there is provided a method of data transmission system for use in pipeline systems which comprises the steps of: forming a current loop path comprising a portion of an inner conductive member and a corresponding portion of an outer conductive member electrically connected to one another at two spaced locations, the outer conducting member surrounding the inner conductive member and being part of the metallic structure of a pipeline system;

injecting a signal into the current loop path from an internal unit disposed within the outer member; and disposing an external unit outside the outer member which unit comprises inductive coupling means arranged to be linked by flux generated by current flowing around the loop path, and the arrangement being such that in use the current flowing in said portion of the inner member does not match the current flowing in the corresponding portion of the outer member whereby signals are generated in the inductive coupling means so allowing communication from the internal unit to the external unit.

Generally the inner and outer members will be generally co-axially arranged elongate members, the outer member being generally tubular.

The spaced locations may separated by a selected minimum distance. Preferably the minimum distance is selected to give desired transmission characteristics. In some embodiments, the data transmission system may be arranged for use in pipeline systems comprising a conductive flowline which acts as the outer member and a dedicated inner conductive member may be provided. In such a case the inner conductive member my comprise a conductive strop connected between two pigs. The electrical connections between the dedicated inner conductor and a flow line may be provided at the pigs. Cleaning brushes located on the pigs may act as contacts with the inner surface of the flowline.

In other embodiments, the data transmission system may be arranged for use in pipeline systems comprising an inner conductive flowline and an outer conductive casing. In such a case the outer member may comprise the casing and the inner member may comprise the flowline.

The outer member, particularly when a casing, may comprise a plurality of separate sections, which may be screwed together. Mating surfaces at one or more joint between adjacent sections may be coated with an isolating medium. This can change the electrical characteristics of the metal structure and enhance performance. It is preferred that no completely isolated joint is disposed in the casing between the spaced locations at which the casing and flowline electrically contact one another.

The electrical connections between the flowline and casing may comprise glancing contacts and/or conductive packers. Where the spaced connections consist of glancing contacts it is possible to select a minimum separation between the connections. Where conductive packers are used the actual spacing between the packers, and hence the connections, may be chosen. The means for forming the current loop path may comprise an insulating layer provided on the outer surface of the inner flow line and/or the inner surface of the outer casing. The means for forming the current loop path may comprise insulating spacer means.

The positions and/or nature of the connections and/or means used for insulating the portion of the flowline from the corresponding portion of the casing may be chosen to give desired transmission characteristics.

Preferably the transmission means is arranged to apply signals to the inner flowline. An isolation joint may be provided in the flowline and the transmission means may be arranged to signal across the isolation joint.

The inductive coupling means may comprise a toroid disposed around the casing in the region of the current loop. Preferably the inductive coupling means is disposed towards a midpoint between the spaced connections.

Typically the pipeline system comprises a cased section of a well, the production string being the flowline in such a case.

According to a first development of the invention there is provided a data transmission system in which metallic structure of a pipeline system is used as a signal channel and earth is used as return comprising means for forming a signal coupling loop having first and second conducting portions electrically connected to one another at spaced locations, the metallic structure comprising one of the conducting portions, and a local unit having transmitting means for applying a signal to one of the conducting portions whereby in use a potential difference is generated between earth and the metallic structure in the region of the loop which causes a signal to be propagated along the metallic structure away from the loop, wherein the means for forming the loop is arranged to ensure that the spaced locations are separated by at least a minimum distance selected to give desired transmission characteristics and one conducting portion comprises a portion of an elongate deploying member which is arranged to move within and relative to a surrounding portion of metallic structure.

According to a second development of the invention there is provided a data transmission system in which metallic structure of a well is used as a signal channel and earth is used as return, comprising an elongate deployment member arranged to move within and relative to a surrounding portion of metallic structure, a local unit supported on the deployment member and having receiving and/or transmitting means coupled to the deployment member for receiving signals from and/or transmitting signals along the signal channel, and spacer means arranged to ensure that the deployment member and the surrounding portion of metallic structure are spaced from one another for at least a selected minimum distance in the region of the local unit, said minimum distance being selected to give desired reception and/or transmission characteristics.

According to a third development of the invention there is provided a method of data transmission in which metallic structure of a pipeline system is used as a signal channel and earth is used as return comprising the steps of:

arranging a signal coupling loop having first and second conducting portions electrically connected to one another at spaced locations, the metallic structure comprising the first conducting portion, and a portion of an elongate deploying member which is arranged to move within and relative to a surrounding portion of metallic structure comprising the second conducting portion;

applying a signal to one of the conducting portions to generate a potential difference between earth and the metallic structure in the region of the loop and cause a signal to be propagated along the metallic structure away from the loop; and ensuring that the spaced locations are separated by at least a minimum distance selected to give desired transmission characteristics.

The means for forming the loop may comprise conductive centralising means arranged to keep the deployment member away from the surrounding portion of metallic structure for a predetermined minimum distance whilst also providing connection between the conducting portions at one of the spaced locations.

The deployment member may comprise coiled tubing.

The local unit may comprise receiving means for receiving incoming signals transmitted along the metallic structure.

According to yet another aspect of the present invention there is provided apparatus for use with a metallic structure in carrying out any one of the above aspects of the invention.

Embodiments of the present invention will now be described by way of example only with reference to the accompanying drawings in which:

FIG. 1 schematically shows a subsea well including a data transmission system which comprises a first embodiment of the invention;

FIG. 2 schematically shows a portion of the well shown in FIG. 1 at which a relay station is disposed;

Figure 9:
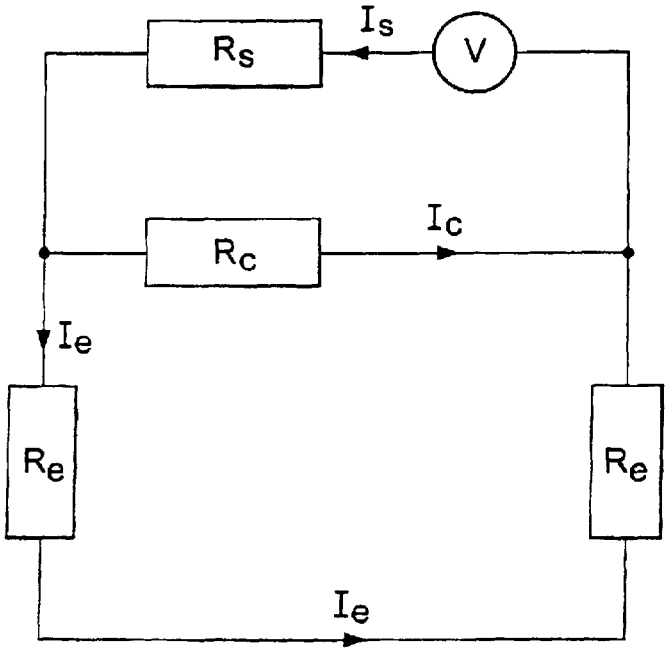
Figure 8:
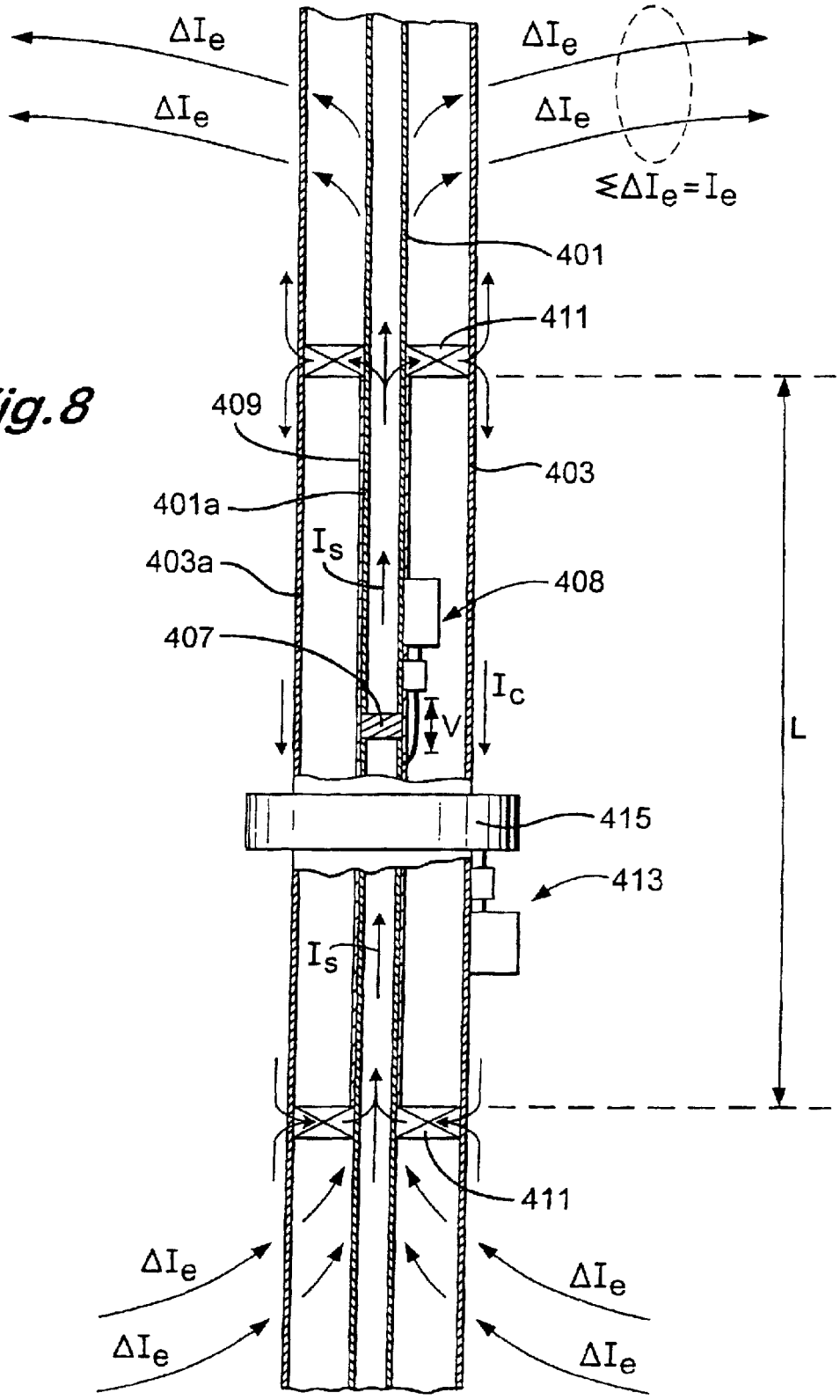
Figure 10:
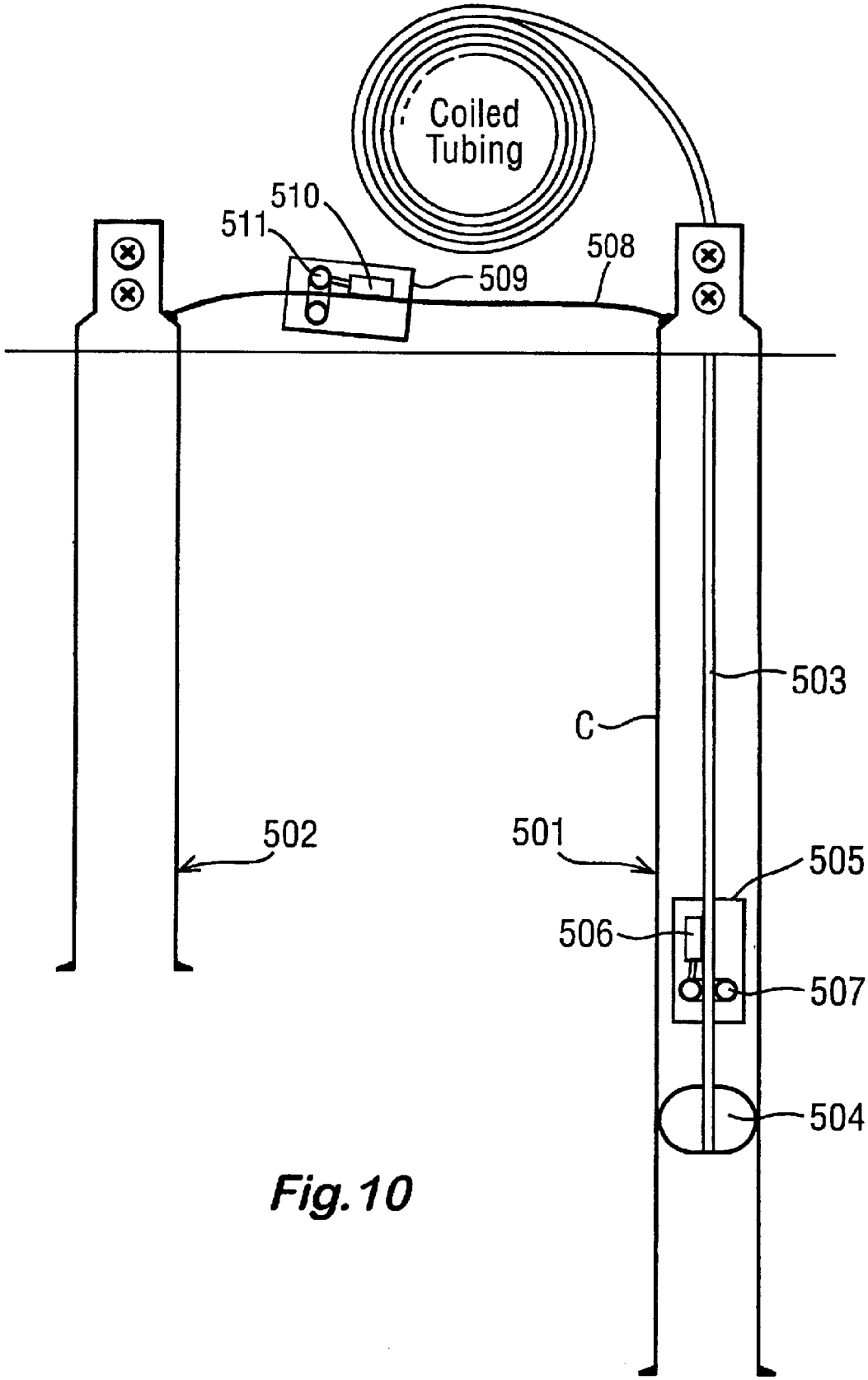

FIG. 8 schematically shows a third embodiment of the present invention;

FIG. 9 shows an equivalent circuit for the arrangement shown in FIG. 8; and FIG. 10 schematically shows a further embodiment of the present invention.

Figure 1:
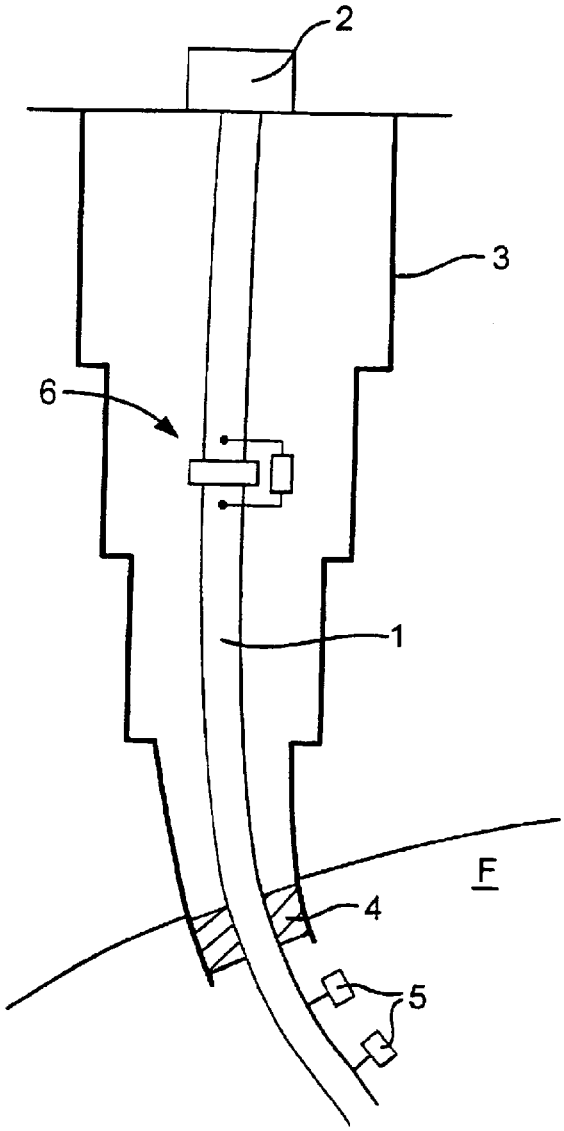
Figure 2:
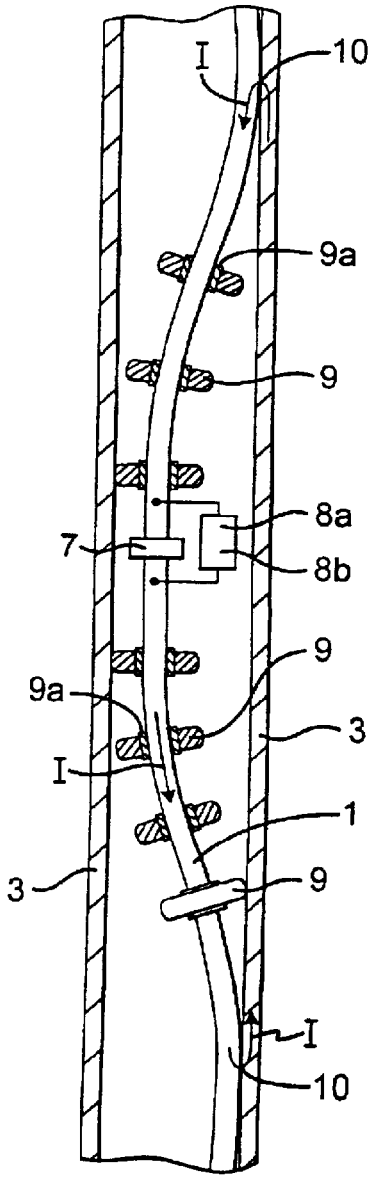

FIGS. 1 and 2 schematically show a subsea well including a wireless or non-wireline data transmission system. The well comprises a production string 1 for extracting product from a formation F. The production string 1 joins a tree 2 at the mudline and is surrounded by casing 3 between the tree 2 and the formation F. The string 1 and casing 3 form part of the metallic structure of the well. Although FIG. 1 shows the string 1 as being disposed centrally within the casing 3, in practice the string 1 and casing 3 will make glancing contact with one another at numerous positions along their lengths. In general there is nothing to prevent such glancing contact and the string 1 will follow a sinuous, for example a helical, path within the casing 3.

The space between the string 1 and casing 3 is filled with brine (or alternatively another fluid which is denser than water) to help reduce the pressure acting on the packing ring 4 provided between the casing 3 and string 1 as they enter the formation F. The presence of the brine introduces a further conduction path between the string 1 and the casing 3.

The effect of the glancing contacts and conduction through the brine mean that in general corresponding points of the string 1 and casing 3 will reach the same potential and the string 1 and casing 3 must be treated as a single conductor.

The well also comprises a number of data logging stations 5 provided on the string 1 at open well locations, that is within the formation. The data transmission system is arranged to allow data to be transmitted between the data logging stations 5 and the mudline or beyond by using the metallic structure of the well 1,3 as a signal channel. The distance between the data logging stations and the mudline may be in excess of 3000 meters. Data is received at and transmitted from the data logging stations 5 using existing non-wireline open well techniques, for example those described in the applicant's earlier application EP-A-0,646,304. Whilst these techniques work in the open well and can transmit a signal along the cased section they cannot be used in practice to transmit from a position within the cased section. Only if the length of the cased section is not too great can signals be received directly at and sent directly from the mudline using the non-wireline techniques described in the above mentioned application; range and data rate being essentially determined by signal to noise ratio.

In the present embodiment however, the strength of the signal and/or range of the system is improved by providing a relay station 6 partway along the cased portion of the production string 1. Referring particularly to FIG. 2, the relay station 6 comprises transceiver means including an isolation joint 7 provided in the production string, signal generating means 8*a* used during transmission and signal measuring means 8*b* used during reception. Both the signal generating means and the signal measuring means are connected across the isolation joint 7. A plurality of insulating annular spacers 9 are provided around the production string 1 over a distance of the order of 100 meters in the region of the isolation joint 7. The distance over which the spacers 9 are provided is chosen such that signals can be effectively received and transmitted. The actual distance will depend on a number of factors relating to the components of the transmission system and the well itself.

The spacers 9 are of a half shell type which are bolted together around the string 1. An insulating layer 9*a* is provided between each spacer and the string 1. In FIG. 2, a side view of one of the spacers 9 is shown and the remainder of the spacers 9 are shown in cross-section. The spacers 9 are arranged and positioned such that at each spacer 9 the string 1 is held towards the centre of the casing 3 and such that the string 1 will not contact with the casing 3 at any position between adjacent spacers 9. Beyond the last spacer 9 at each end of the plurality of spacers 9, the string 1 makes glancing contact 10 with the casing 3 as shown in FIG. 2. The distance between each last spacer 9 and the respective glancing contact 10 will be random but its lower limit will be determined by characteristics of the well and spacers 9. Thus the spacers 9 ensure that there is no contact between the string 1 and casing 3 for at least a selected minimum distance.

In general terms the transmission and receiving characteristics of the system improve as the spacing between the glancing contacts 10 is increased. However, there is a trade off against the cost involved in lengthening the minimum distance. In general the actual spacing between the glancing contacts 10 will be greater than the minimum distance but this simply serves to improve the system.

The portions of the string 1 and casing 3 between the glancing contacts 10 are hereinafter referred to as the isolated portion of the string 1*a* and the corresponding portion of the casing 3*a*.

Figure 3:
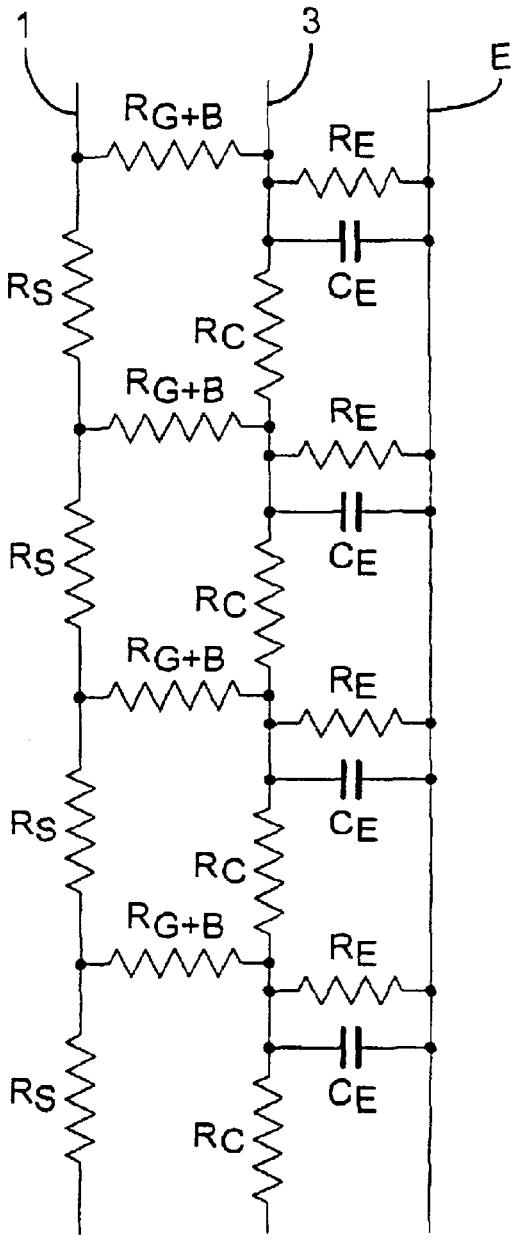
FIG. 3 shows a simplified equivalent circuit of a typical length of production string and casing of the well shown in FIG. 1.

FIG. 3 shows an equivalent (lumped parameter) circuit for a typical length of the production string 1 and casing 3. The string 1 and casing 3 are respectively represented by series of resistors $R_s$ and $R_c$. The leakage paths between the string 1 and casing 3 are represented by a series of resistors $R_{g+b}$ and the leakage paths between the casing 3 and remote earth E are represented by resistors $R_e$ and capacitors $C_e$. If a signal is applied to the string 1 or casing 3 the strength of the signal will decrease with distance away from the source due to the losses through the leakage paths to remote earth E. Further, as mentioned above the potential of the string 1 and casing 3 will tend to equalise.

Figure 4:
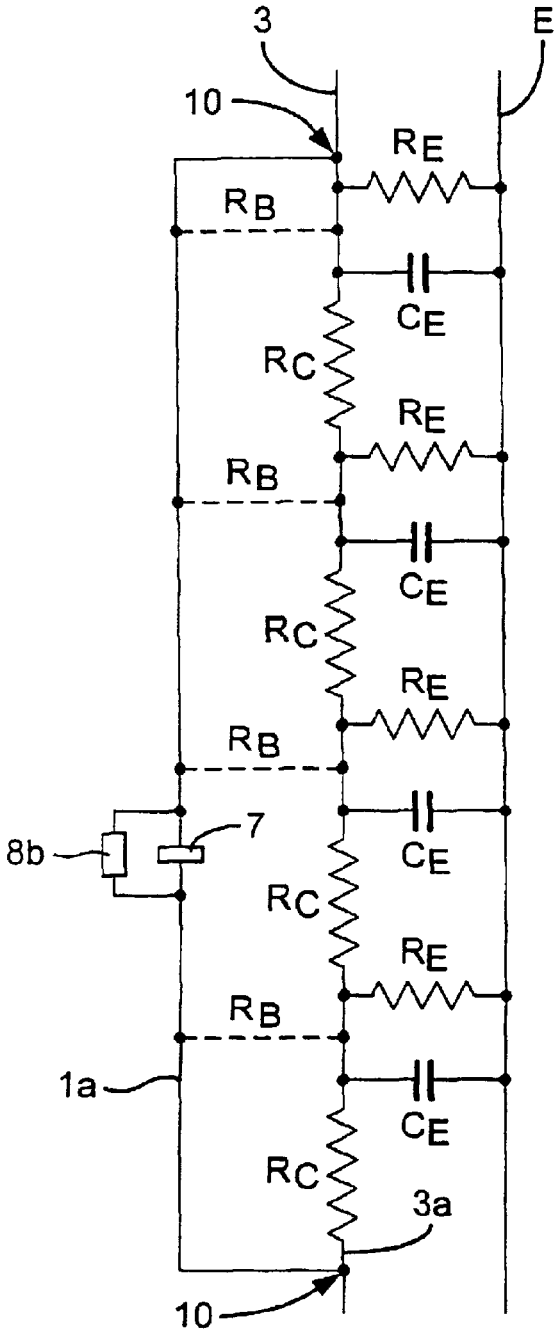
FIG. 4 shows a simplified equivalent circuit of the portion of the well shown in FIG. 2 during reception of a signal.

FIG. 4 shows a simplified equivalent circuit for the portions of the production string la and casing 3*a* in the region of the relay station 6 during reception of a signal. Except those 10 at either end of the portions 1*a*, 3*a*, the leakage paths due to glancing contacts have been removed. Thus the resistors $R_{g+b}$ are replaced by resistors $R_b$ of much higher value representing the leakage through brine alone. The resistance through the brine in the region of the relay station 6 is so large compared with that provided by the glancing contacts 10 at the ends of the isolated portion of string 1*a* that the effect of the brine can essentially be ignored.

During reception of a signal, because there is no current path through the string portion 1*a* due to the isolation joint 7 and because the string portion 1*a* is effectively isolated from the corresponding casing portion 3*a*, all of the signal losses for that section of the metallic structure will be from the casing 3*a*. In this circumstance there will be little potential drop along the two halves of the isolated string portion 1*a* which essentially provide a direct contact with the glancing contacts 10 at the end of the portions 1*a*,3*a*. This means that the potential difference between two longitudinally spaced locations on the casing can be detected and hence a signal extracted from the metallic structure. The fact that all of the signal is forced along the casing 3 in the region of the relay station 6 can serve to increase the potential difference between the two spaced locations on the casing 3.

Figure 5:
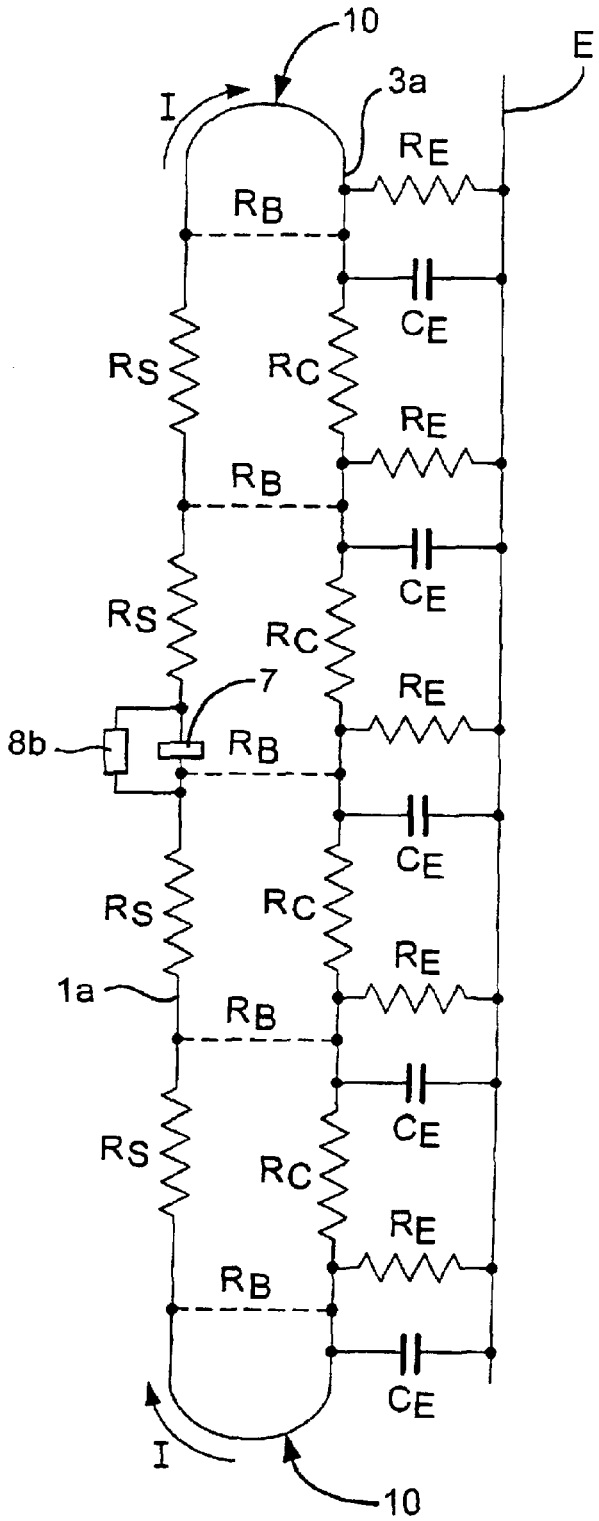
FIG. 5 shows a simplified equivalent circuit of the portion of the well shown in FIG. 2 during transmission of a signal.

FIG. 5 shows a simplified equivalent circuit for the portions of the production string 1*a* and casing 3*a* in the region of the relay station 6 during transmission. As above the leakage paths due to glancing contacts have been removed except those 10 at either end of the portions 1*a*, 3*a*. Thus the resistors $R_{g+b}$ are replaced by resistors $R_b$ of much higher value representing the leakage through brine alone. The resistance through the brine in the region relay station 6 is so large compared with that provided by the glancing contacts 10 at the ends of the isolated portion of string 1*a* that the effect of the brine can be ignored. Thus during transmission a current loop path can be considered to exist consisting of the isolated portion of the string 1*a*, the corresponding portion of the casing 3*a* and the glancing connection points 10. The two ends of this loop are of course also connected to the remainder of the string 1 and casing 3. The signal generating means 8*a* causes a current I to flow around the loop path. This flow of current I causes a potential difference to be set up between the glancing contacts 10 at opposite ends of the isolated portion of string 1*a*. This potential difference will be I×sumRc, where sumRc equals the total resistance of the casing between the glancing contacts 10.

Assuming that the isolation joint 7 is provided at the centre of the isolated portion of the string 1*a* and the system settles in balance relative to earth, the magnitude of the potential difference between metallic structure and earth at each end of the isolated portion 1*a* will be (I×sumRc)/2. Because a potential difference exists between the positions of the glancing contacts 10 and earth, a signal will tend to travel along the string 1 and casing 3 in each direction away from the relay station 6.

Desired data, for example that received from a data logging station, can be transmitted along the string 1 and casing 3 away from the relay station by encoding a suitable signal onto the string 1 by means of the mechanism described above. The resulting signal propagates away from the current loop path along the string and casing as a single conductor. The signal circuit is completed by an earth return and no wirelines are required. Thus all of the problems associated with the provision of wirelines, especially downhole, can be avoided.

Appropriate receiving means at the mudline or at another relay station (not shown) are used to detect the signal applied to the string 1 and casing 3 and extract the desired data. The receiving means may make use of an inductive coupling or be arranged to measure signals with respect to a separate earth reference.

Thus the range of the signal transmission system can be dramatically increased by providing a suitable number of relay stations within the casing 3. The relay stations are bidirectional so that the transmission range when transmitting signals down into the well as well as out of the well is increased.

With the isolation joint located centrally within the isolated portion 1*a*, the signals in each direction away from the relay station 6 will have substantially equal strength. However, if the isolation joint 7 is disposed towards one end of the isolated portion 1*a*, the potential difference generated at the other end of the isolated portion 1*a* will tend to be greater than (I×sumRc)/2. Thus if it is desired to increase the strength of the signal in one direction the isolation joint 7 may be disposed accordingly.

In an alternative the isolated portion of the production string 1*a* is provided with an insulating coating to further reduce conduction between the isolated portion la and the corresponding portion of the casing 3*a*.

Figure 6:
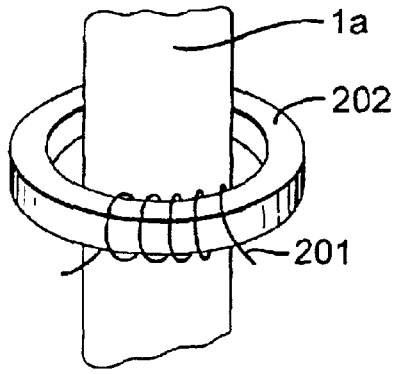
FIG. 6 shows an alternative coupling method.

FIG. 6 shows a coil 201 provided on a toroidal core 202 disposed around the production string portion 1*a* for use in an alternative method of applying a signal to and/or tapping a signal from the production string 1. In this case inductive coupling is relied on and no isolation joint is used. During transmission the coil 201 is used to induce a current in the string 1 and the current loop path described above acts as a single turn transformer winding. During reception, a signal on the production string 1 induces a corresponding current in the coil 201 which can be detected. This method of reception does not rely on there being an isolated portion 1*a* of production string. This coupling method gives an advantage that it is possible to optimise impedance matching by appropriately choosing the turns ratio.

Figure 7:
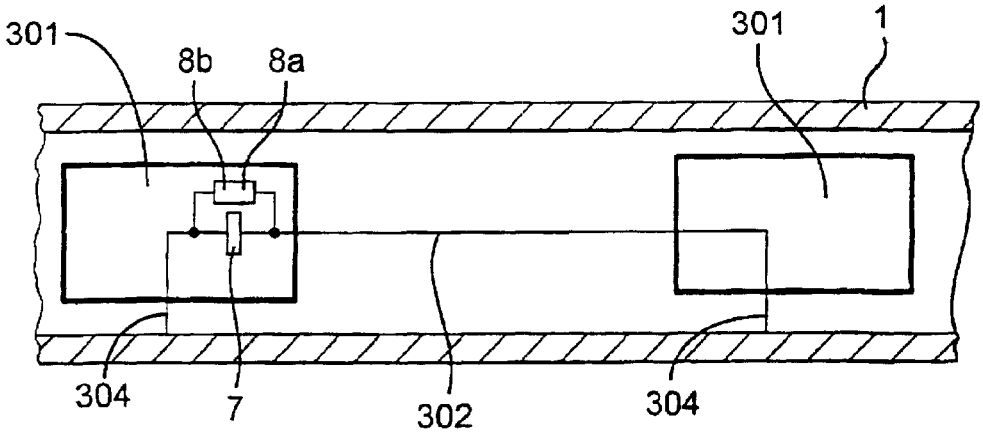
FIG. 7 is a schematic view of part of a second embodiment of the invention.

FIG. 7 shows a further embodiment of the invention suitable for use in a well of the type described above which comprises two pigs 301 connected by an electrically conductive strop 302 and disposed within the production string 1 which may or may not be cased. A first of the pigs 301 comprises a local station 303 having an isolation member 7 provided in series with the strop 302 and signal generating means 8*a* and signal measuring means 8*b* connected across the isolation member 7. Each of the pigs 301 has a contact 304 for contacting with an internal surface of the string 1.

Signals may be transmitted and received in this embodiment in substantially the same way as described above in relation to the first embodiment. During transmission the strop 302, a portion of the string 1*a* and the contacts 304 form a current loop path. When current is caused to flow around the loop by the signal generating means 8*a* a potential difference between the string 1 and earth can be generated at each contact 304 allowing a signal to be transmitted. During reception of a signal, the strop 302 and contacts 304 allow the potential difference between two longitudinally spaced points on the string 1 to be measured so that a signal can be extracted from the string 1.

In this embodiment signals may be sent to and from the first pig 301. In particular, signals may be sent from the pig 301 which allow the location of the pig 301 to be determined and/or which represent a quantity, such as wall thickness, measured by the pig 301.

In implementing this embodiment it is desirable to minimise the impedance of the conductive strop 302 and the contacts 304 between the pigs 301 and the production string 1. Wire brushes (not shown) provided around the pigs 301 for cleaning purposes may be used as the contacts 304.

One possible mechanism for determining the location of the pig 301 would be to arrange trigger means at spaced locations along a pipeline which cause the pig 301 to send an appropriate signal. Another method would be to determine the time difference of arrival of the signal at each end of the pipeline.

It will be appreciated that this system may be used whether the pigs 301 are within a cased or uncased section of string. Further the system may be used in other pipeline systems besides wells.

In alternatives more than two pigs may be used. Three pigs connected by two conductive members may be used and the local unit disposed at the central pig. This can facilitate equalisation of the transmission characteristics in both directions away from the local unit.

FIG. 8 schematically shows a third embodiment of the present invention which is a system for transmitting data from inside a section of a cased well to a substantially adjacent position outside of the casing.

Referring to FIG. 8 a metallic production string 401 is surrounded by a metallic casing 403 which form part of a cased well. An isolation joint 407 is provided in the string 401 and an internal unit 408 including transmitting means (not shown) is connected across the isolation joint 407. At equally spaced distances from the isolation joint 407, generally annular electrically conductive packers 411 are provided between the string 401 and casing 403. The electrically conductive packers 411 are spaced by a selected distance L and provide a good electrical connection between the production string 401 and the casing 403.

The portion 401*a* of the production string 401 between the spaced pair of packers 411 is provided with an insulating coating 409. The coating 409 helps to ensure that there is no conduction path or at least only a very poor conduction path between the string 401 and casing 403 at all points between the packers 411.

An external unit 413 comprising receiving means (not shown) and a toroid 415 is provided outside of the casing 403 at a position which is between the pair of spaced packers 411. The toroid 415 surrounds the casing 403 and is arranged to act as an inductive coupling means such that any net magnetic flux flowing through the toroid generates a signal which can be detected by the receiving means (not shown).

The system is arranged to be used to transmit signals from the internal unit 408 to the external unit 413 by the mechanism described below.

The insulated portion of the production string 401*a*, a corresponding portion of the casing 403*a*, and the pair of conductive packers 411 form a current loop path around which current may flow. However, the loop is imperfect such that there are other current flow paths and losses will occur. There can be considered to be a leakage loop via earth which accounts for the losses.

The current flow, at an arbitrary instant, around the current loop path as well as along the leakage paths is shown by arrows in FIG. 8. $I_s$ represents the current flowing through the insulated portion 401*a* of production string 401, $I_c$ represents the current flowing in the corresponding portion of the casing 403*a* and $I_e$ represents the leakage current to earth.

At the particular instant represented by the arrows in FIG. 8, current $I_s$ flows up the production string 401 away from the isolation joint 407, a portion of the current passes through the conductive packer 411 to the casing 403 but a further portion of the current continues up the string with subsequent losses to earth. At the casing 403 the path splits again and a proportion of the current $I_c$ continues around the current loop path while the remainder travels along the casing 403 away from the current loop path and contributes to the leakage to earth. At the lower end of the insulated portion of the string 401*a*, current from the casing $I_c$ returns to the string 401 via the respective conductive packer 411 and leakage currents from earth $I_e$ join this flow back towards the isolation joint 407.

FIG. 9 shows a simplified equivalent circuit for the current loop path and the leakages to earth. The resistances of the portion of the production string 401*a*, the corresponding portion of the casing 403*a* and earth are represented by a resistors $R_s$,$R_c$,$R_e$ respectively.

From the equivalent circuit and the above description, it can be seen that $I_s=I_c+I_e$. It follows that the current $I_s$ flowing through the insulated portion of the production string 401*a* does not equal the current $I_c$ flowing through the corresponding portion of the casing 403*a*. This in turn means that there is a net magnetic flux generated by the current flowing around the loop path. The loop path is encircled by the toroid 415 and hence the toroid 415 is linked by the net flux. Therefore, as current flows around the loop, the existence of, and variations in, that current may be detected by monitoring signals generated in the toroid 415.

It therefore becomes possible to communicate between the internal and external units 408,413 by injecting appropriate signals onto the production string 401 and monitoring the signals generated in the toroid 415.

For this technique to work it is important that not all of the current $I_s$ which is injected into the production string 401 continues around the current loop. That is to say, significant and appropriate leakages to earth and/or away from the current loop must be provided for. In practice such leakages will tend to occur because of the existence of the remainder of the metallic structure of the well and because the casing 403 will be in contact with earth or another conductive medium, such as sea water.

The level of signal obtained in the toroid 415 can be adjusted by making appropriate design choices. For example, the position of the toroid along the insulated portion of the string 401*a* and the position of the isolation joint 407 may be selected. Further, the spacing L between the conductive packers 411 may be changed, as may the length of the insulated portion of the production string 401*a*. The aim is to maximise the receivable signal by increasing the resistance of the casing loop $R_c$ relative to the leakage resistance $R_e$ as far as is practicable. In the first instance this may be achieved by increasing the spacing between the conductive packers. Theoretically there will come a point where spacing between the packers is electrically optimised, since increased spacing, at some stage, will begin to significantly increase the resistance of the leakage path $R_e$. Generally however, other practical considerations will prevent this electrical optimised spacing being reached. The exact nature and conductive properties of the packers 411 may also be selected to vary performance.

Although the position of the toroid along the current loop path/insulated portion 401*a* is not crucial, the best results are likely to be achieved towards a central position to balance signals generated during positive and negative going cycles and avoid any undesirable edge effects.

It will be noted that this system does not require insulation between the production string 401 and the casing 403 along the whole of the well's length, it is merely preferable along the length chosen to give the necessary transmitting characteristics.

Although this technique has been described with reference to a cased portion of a well, it will be appreciated that the technique is equally appropriate for other situations where it is desired to signal from within a conductive member which surrounds the transmitter. For example, the system can be used to signal from within the casing of flow lines other than production strings and from within flow lines themselves providing that a suitable inner conductor is provided.

In a particular case this system can be used with apparatus along the lines of that shown in and described with reference to FIG. 7. That is to say the current loop path may be formed by a portion of a flow line 1, two pigs 301 and an interconnecting conductive strop 302. If a toroid is then provided around the flow line 1 it will be possible to pick-up signals generated by the transmitting means 8*a* located in the pig 301 as it passes through the region of the toroid.

It can be noted that this embodiment makes use of the same phenomenon as described above with reference to the first and second embodiments. However, in the present embodiment it is the effects which occur in the current loop path itself which are used rather than the current which leaks away from the current loop path along the production string and casing 1,3.

It should also be noted that the implementation of the present embodiment will, at least in some circumstances, be compatible with the previously described embodiments. Thus systems may be provided in which signalling along the metallic structure to a remote location and signalling from within the casing to adjacent equipment outside of the casing is possible.

Although not shown in the drawings, the casing 3 of a well is typically made up of screwed together sections. In alternative implementations of the invention, some or all of the joints between the casing sections may be treated so as to cause a level of discontinuity in conductivity of the casing. This can typically be achieved by coating the mating surfaces at each joint with an isolating medium which does not prejudice the sealing requirements for the casing.

Introducing such discontinuities can significantly change the electrical characteristics of the well as a whole. At least in some circumstances this may lead to improved performance of the relevant embodiments described above. For example the range of transmission systems shown in FIGS. 1 and 2 may be improved. Improvements can be achieved whether the discontinuities are provided in the region of the current loop path, i.e. between the spaced connections or away from that region. The tendency is to force more of the signal into the string rather than the casing and to increase the proportion of the signal which travels away from the region of the loop.

In the case of the system shown in FIG. 8, the inclusion of an isolation medium between sections of the casing in the region between the spaced connections particularly aids performance as it reduces the screening effect of the casing. Looked at another way, it tends to increase the impedance of the string-casing loop and thus increase the difference between the current flowing in the string $I_s$ and in the casing $I_c$.

It should be noted that, although as mentioned above, the present embodiments, and present invention in general, may function better if discontinuities exist between mating sections of casing this is not a requirement for operation. Thus the system may be such that the casing is substantially electrically continous along its whole length or at least in the region of the loop. This is true for the casing of a well and the casing of any other pipeline as well for as any corresponding surrounding outer member such as the string in the embodiment shown in FIG. 7.

FIG. 10 shows a further pipeline system embodying the present invention. In particular, FIG. 10 shows two adjacent wells 501, 502. In this case a first of the wells 501 is being studied, whereas a second of the wells 502 is merely acting as part of an earth return circuit.

A deployment member 503 comprising a length of coiled tubing is disposed within the first well 501. In accordance with standard practice in the field of oil and gas wells, this coiled tubing 503 is arranged to be movable relative to the casing C of the well 501. Therefore, the tubing 503 and anything supported on it may be moved up and down the length of the well 501.

The end of the coiled tubing 503 is provided with a conductive centraliser 504 which both serves to keep that end of the coiled tubing 503 away from the casing and to provide electrical contact between the coiled tubing 503 and the casing C.

A local unit 505 is supported on the coiled tubing 503 in a region near the conductive centraliser 504. The local unit 505 comprises transmitting and receiving means 506 and a toroid 507 provided around the coiled tubing 503. These components are arranged so that signals may be transmitted from, and received at, the local unit 505 via the coiled tubing 503.

The metallic structure, including the respective casings C of the first and second wells 501, 502 is connected via a cable 508. A surface unit 509 is provided adjacent the cable 508 and comprises transmitting and receiving means 510 and a toroid 511 disposed around the cable 508.

In operation, the embodiment of the present invention functions in a way similar to the systems described above with reference to FIGS. 1 to 7. In particular, the mechanisms described above allow the transmission of signals to and from the local unit 505 which is disposed in casing C.

It should be noted that although the coiled tubing 503 is shown to be displaced from the casing C along its length, in practice it will make glancing contact with the casing at a number of locations between the local unit 505 and the surface. On the other hand the conductive centraliser 504 ensures that there is a selected minimum spacing (in this embodiment the selected minimum spacing may be as little as 10 meters) between the connection provided by the centraliser 504 and the glancing connection nearest to the local unit 505. Thus current flow behaviour substantially the same as that described with reference to FIGS. 1 to 7 will occur allowing the local unit 505 to both inject signals onto the coiled tubing 503 and extract signals from the coiled tubing 503.

It will be appreciated that away from the region of the local unit 505 the coiled tubing 503 and casing C will essentially act as a single conductor and that the coiled tubing is a relatively good electrical conductor and typically metallic.

In the arrangement shown in FIG. 10, the adjacent well 502 provides a convenient earthing point to allow completion of the signal circuit, but it will be appreciated that it is not essential to use a second well to provide the earth connection.

The present embodiment facilitates the extraction of data from various positions within a well 501. Although not shown in detail, the local unit 505 will generally comprise a number of sensors for measuring parameters such as pressure and temperature. The system allows the results of such measurements to be encoded onto signals which are transmitted away from the local unit 505 and received at the surface unit 509. It will be immediately apparent that as more coiled tubing 503 is fed into the well 501, the local unit 505 will traverse down the well 501 and measurements may be made and output from each location through which the local unit 505 passes. The system is such that signalling may be achieved whilst the local unit is on the move and/or when the local unit is stationary.

Although this embodiment has been described with particular reference to the use of coiled tubing within a cased section of a well it will be appreciated that the system may also be used in other situations where there is a conductive elongate deployment means which is arranged to move within and relative to a surrounding conductive member.

In this application the phrase conductive centraliser should be construed broadly to include any electrically conductive device which serves to keep the inner conductive portion away from the surrounding conductive portion.

What is claimed is:

1. A data transmission system in which metallic structure of a pipeline system is used as a signal channel and earth is used as return, comprising: current loop path forming apparatus, said current loop path for use in applying signals to the signal channel and earth return circuit, the loop having first and second conducting portions electrically connected to one another at a first location and electrically connected to one another at a second location, the second location being spaced from the first location, and the metallic structure comprising at least one of the conducting portions; and a local unit having a transmitter for applying a signal to one of the conducting portions, whereby in use a potential difference is generated between earth and the metallic structure in the region of the loop which causes a signal to be propagated along the signal channel provided by the metallic structure away from the loop, wherein the loop forming apparatus is arranged to ensure that the spaced locations are separated by at least a minimum distance selected to give desired transmission characteristics, and the transmitter comprises an inductive coupling arrangement disposed around the respective conducting portion.

2. A data transmission system according to claim 1 in which the transmitter is arranged to apply signals substantially at the midpoint of the respective conducting portion.

3. A data transmission system according to claim 1 in which one conducting portion comprises a portion of one of a pipeline and a flowline and the other conducting portion comprises at least one electrically conductive elongate member connecting at least two pigs disposed within said one of a pipeline and a flowline and wherein the spaced connections to complete the current loop path are provided at the pigs.

4. A data transmission system according to claim 1 in which the local unit comprises a receiver for receiving incoming signals transmitted along the metallic structure.

5. A data transmission system according to claim 4 in which the local unit is arranged to act as a relay station.

6. A data transmission system according to claim 1 in which the pipeline system comprises an inner flow line and a surrounding case wherein, one conducting portion comprises a portion of the flow and the other conducting portion comprises a surrounding portion of the casing.

7. A data transmission system according to claim 6 in which the loop forming apparatus comprises at least one insulating spacer for keeping the flow line spaced from the surrounding casing for the selected minimum distance.

8. A data transmission system according to claim 6 in which the spaced connections between the first and second conducting portions comprise glancing contacts between the flow line and casing beyong the selected region.

9. A method of data transmission in which metallic structure of a pipeline system is used as a signal channel and earth is used as return of comprising the steps of:

arranging a current loop path for use in applying signals to the signal channel and earth return circuit, the loop having first and second conducting portions electrically connected to one another at a first location and electrically connected to one another at a second location, the second location being spaced from the first location, and the metallic structure comprising at least one of the conducting portions;

applying a signal to one of the conduction portions using an inductive coupling arrangement disposed around the respective conducting portion to generate a potential difference between earth and the metallic structure in the region of the loop and cause a signal to be propagated along the signal channel provided by the metallic structure away from the loop; and ensuring that the spaced locations are separated by at least a minimum distance selected to give desired transmission characteristics.

10. Signal receiving apparatuds for use with a data transmission system in which metallic structure of a pipeline system is used as a signal channel and earth is used as return, comprising a local unit having a receiver, an arrangement for providing electrical contact between the local unit and at least two spaced locations on a portion of the metallic structure and an arrangement for ensuring that the two spaced locations are separated by at least a minimum distance selected to give desired reception characteristics, wherein said arrangement for providing electrical contact includes a first electrically conductive member portion for connecting the local unit to a first of the two locations and a second electrically conductive member portion for connecting the local unit to a second of the two locations, and wherein the receiver comprises an inductive coupling arrangement disposed around a respective conductive portion.

11. A data transmission system for use in pipeline systems which transmission system comprises:

apparatus for forming a current loop path comprising a portion of an inner conductive member and a corresponding portion of an outer conductive member electrically connected to one another at two spaced locations, the outer conductive member surrounding the inner conductive member and being part of the metallic structure of a pipeline system;

an internal unit disposed within the outer member and having a transmitter for injecting a signal into the loop; and an external unit disposed outside the outer member and comprising an inductive coupling arrangement arranged to be linked by flux generated by current in the loop, the arrangement being such that in use the current flowing in said portion of the inner member does not match the current flowing in the corresponding portion of the outer member whereby signals are generated in the inductive coupling arrangement so allowing communication from the internal unit to the external unit.

12. A data transmission system according to claim 11 in which the spaced locations are separated by at least a selected minimum distance chosen to give desired transmission characteristics.

13. A data system according to claim 11 in which the apparatus for forming the loop comprises insulating spacer means.

14. A data transmission system according to claim 11 which is arranged for use in a pipeline system comprising an inner conductive flowline and an outer conductive casing, said outer member comprising part of the casing and said inner member comprising part of the flowline.

15. A data transmission according to claim 14 in which the casing comprises a plurality of separate sections and mating surfaces at at least one joint between adjacent sections are coated with an isolating medium.

16. A data transmission system according to claim 14 in which the electrical connections between the flowline and casing comprise at least one of glancing contacts and conductive packers.

17. A method of data transmission for use in pipeline systems which method comprises the steps of:

forming a current loop path comprising a portion of an inner conductive member and a corresponding portion of an outer conductive member electrically connected to one another at two spaced locations, the outer conductive member surrounding the inner conductive member and being part of the metallic structure of a pipeline system;

injecting a signal into the loop form an internal unit disposed within the outer member; and disposing an external unit outside the outer member which unit comprises an inductive coupling arrangement arranged to be linked by flux generated by current flowing the loop, and the arrangement being such that the current flowing in said portion of the inner member does not match the current flowing in the corresponding portion of the outer member whereby signals are generated in the inductive coupling arrangement so allowing communication from the internal unit to the external unit.

18. A method of data transmission according to claim 17 in which the spaced locations are separated by at least a selected minimum distance chosen to give desired transmission characteristics.

19. Apparatus for use with a metallic structure to provide a system according to claim 1.

20. Apparatus for use with a metallic structure to carry out a method according to claim 9.

21. A data transmission system in which metallic structure of a pipeline system is used as a signal channel and earth is used as return comprising signal coupling loop forming apparatus, said loop having first and second conducting portions electrically connected to one another at spaced locations, the metallic structure comprising one of the conducting portions, and a local unit having a transmitter for applying a signal to one of the conducting portions whereby in use a potential difference is generated between earth and the metallic structure in the region of the loop which causes a signal to be propagated along the metallic structure away from the loop, wherein the loop forming apparatus is arranged to ensure that the spaced locations are separated by at least a minimum distane selected to give desired transmission characteristics and one conducting portion comprises a portion of an elongate deploying member which is arranged to move within and relative to a surrounding portion of metallic structure.

22. A data transmission system according to claim 21 in which the loop forming apparatus comprises at least one conductive centraliser arranged to keep the deployment member away from the surrounding portion of metallic structure for a predetermined minimum distance whilst also providing connection between the conducting portions at one of the spaced locations.

23. A data transmission system according to claim 21 in which the deployment member comprises coiled tubing.

24. A data transmission system according to claim 21 in which the local unit comprises a receiver for receiving incoming signals transmitted along the metallic structure.

25. A system according to claim 21 in which signals may be transmitted as the deploying member is moving relative to the surrounding portion of metallic structure.

26. A data transmission system in which metallic structure of a well is used as a signal channel and earth is used as return, comprising an elongate deployment member arranged to move within and relative to a surrounding portion of metallic structure, a local unit supported on the deployment member and having at least one of a receiver and a transmitter coupled to the deployment member respectively for receiving signals from and transmitting signals along the signal channel, and at least one spacer arranged to ensure that the deployment member and the surrounding portion of metallic structure are spaced from one another for at least a selected minimum distance in the region of the local unit, said minimum distance being selected to give at least one of a desired reception and desired transmission characteristics.

27. A method of data transmission in which metallic structure of a pipeline system is used as a signal channel and earth is used as return comprising the steps of:

arranging a signal coupling loop having first and second conducting portions electrically connected to one another at spaced locations, the metallic structure comprising the first conducting portion, and a portion of an elongate deploying member which is arranged to move within and relative to a surrounding portion of metallic structure comprising the second conducting portion;

applying a signal to one of the conducting portions to generate a potential difference between earth and the metallic structure in the region of the loop and cause a signal to be propagated along the metallic structure away from the loop; and ensuring that the spaced locations are separated by at least a minimum distance selected to give desired transmission characteristic.

28. A method according to claim 27 in which signals may be transmitted as the deploying member is moving relative to the surrounding portion of metallic structure.

29. Apparatus for use with a metallic structure to provide a system according to claim 21.

30. Apparatus for use with a metallic structure to carry out a method according to claim 27.

31. A data transmission system in which metallic structure of a pipeline system is used as a signal channel and earth is used as return, comprising means for forming a current loop path for use in applying signals to the signal channel and earth return circuit, the loop having first and second conducting portions electrically connected to one another at a first locatioin and electrically connected to another at a second location, the second location being spaced from the first location, and the metallic structure comprising at least one of the conducting portions, and a local unit having transmitting means for appying a signal to one of the conducting portions whereby in use a potential difference is generated between earth and the metallic structure in the region of the loop which causes a signal to be propagated along the signal channel provided by the metallic structure away from the loop, wherein the means for forming the loop is arranged to ensure that the spaced locations are separated by at least a minimum distance selected to give desired transmission characteristics and the transmitting means comprises an inductive coupling arrangement disposed around the respective conduction portion.

* * * * *

UNITED STATES PATENT AND TRADEMARK OFFICE

CERTIFICATE OF CORRECTION

PATENT NO. : 7,071,837 B2
APPLICATION NO. : 10/032468
DATED : July 4, 2006
INVENTOR(S) : Steven Martin Hudson and Daniel Joinson It is certified that error appears in the above-identified patent and that said Letters Patent is hereby corrected as shown below:

On the title page, item (57), line 1, delete “Data transmission in pipeline systems”.

Column 16, line 5, “case” should read --casing--.

Column 16, line 6, “flow and” should read --flow line and--.

Column 16, line 14, “beyong” should read --beyond--.

Column 16, line 17, “return of comprising” should read --return comprising--.

Column 16, line 27, “conduction” should read --conducting--.

Column 16, line 37, “apparatuds” should read --apparatus--.

Column 17, line 12, “data system” should read --data transmission system--.

Column 17, line 20, “transmission according” should read --transmission system according--.

Column 17, line 37, “form” should read --from--.

Co1umn 17, line 42, “flowing the” should read --flowing in the--.

Column 18, line 3, “distane” should read --distance--.

Column 18, line 36, “of a desired” should read --of desired--.

Column 18, line 55, “characteristic.” should read --characteristics.--.

Column 19, line 2, “locatioin” should read --location--.

UNITED STATES PATENT AND TRADEMARK OFFICE

CERTIFICATE OF CORRECTION

PATENT NO. : 7,071,837 B2
APPLICATION NO. : 10/032468
DATED : July 4, 2006
INVENTOR(S) : Steven Martin Hudson and Daniel Joinson It is certified that error appears in the above-identified patent and that said Letters Patent is hereby corrected as shown below:

Column 19, line 2, "to another" should read --to one another--.

Signed and Sealed this

Twenty-first Day of November, 2006

JON W. DUDAS
*Director of the United States Patent and Trademark Office*